United States Patent [19]

Wilcoxson

[11] Patent Number: 4,463,555

[45] Date of Patent: Aug. 7, 1984

[54] ELECTRO-DYNAMIC POWER CONVERTER

[76] Inventor: Henry V. Wilcoxson, P.O. Box 141021, Dallas, Tex. 75214

[21] Appl. No.: 395,651

[22] Filed: Jul. 6, 1982

[51] Int. Cl.[3] ..... F15B 3/00

[52] U.S. Cl. ..... 60/325; 60/669

[58] Field of Search ..... 60/325, 513, 39.44, 60/669, 651, 670, 671, 643, 645; 415/92

[56] References Cited

U.S. PATENT DOCUMENTS

| | | | |
|---|---|---|---|
| 1,063,537 | 6/1913 | Hall | 415/92 X |
| 3,398,686 | 8/1968 | Gvin | 60/513 X |
| 4,209,983 | 7/1980 | Sokol | 60/39.44 X |

*Primary Examiner*—Stephen F. Husar

*Attorney, Agent, or Firm*—Dennis T. Griggs

[57] ABSTRACT

An electro-dynamic power converter for transforming the kinetic energy of a moving stream of water into rotary power is disclosed. A turbine rotor is received within a power flow housing and has turbine blades for imparting a mechanical turning force on the rotor in response to fluid flow through the power flow housing. An impulse chamber having sidewall portions defining a diverging passage is coupled to the power flow housing inlet port. Electrodes are received within the impulse chamber for conducting an electrical discharge within the impulse chamber. When an electrical arc is conducted between the electrodes, the water flowing through the impulse chamber into the power flow chamber is vaporized, and a shock wave is propagated through the impulse chamber. The shock wave is reacted in part by the mass of the water in the impulse chamber, and by baffle plates. The shock waves and the expanding water vapor provide increased torque output.

4 Claims, 4 Drawing Figures

ELECTRO-DYNAMIC POWER CONVERTER

BACKGROUND OF THE INVENTION

1. Field of the Invention

This invention relates to hydraulic turbines, and in particular to an electric discharge device for increasing the power output of a hydraulic turbine.

2. Description of the Prior Art

Mechanical power can be derived from hydraulic turbines or water wheels. This mechanical power can be used directly, or it can be used to drive an electrical generator. The power output of the turbine is directly proportional to the head or water pressure by which it is driven. Conventional hydraulic turbines have utilized the gravitational energy available from water flowing from a high level to a lower level in descending natural water courses. Conventional hydraulic turbines have been characterized by high initial costs and extremely large physical size. Consequently, such installations have been concentrated near of large bodies of water.

The hydraulic turbine is a machine which converts the energy of an elevated water supply into mechanical energy of a rotating shaft. Most conventional water wheels utilize the gravity effect of the water directly, but all modern hydraulic turbines are a form of fluid dynamic machinery of the jet-and-vane type operating on the impulse or reaction principle and thus involves the conversion of pressure energy to kinetic energy.

The hydraulic turbine is rated according to its prime capacity, that is the amount of power produced by the turbine which is continuously available. The rated prime capacity of a given turbine may not, in some instances, be adequate to meet the demands of peak loading. This is true for small scale installations where the amount of head or water pressure is limited. In those small scale installations which are used to generate electrical power for household use, the speed of the generator must be maintained at an acceptable synchronous value. Mechanical arrangements including adjustable propeller blades and adjustable nozzles have been used to maintain synchronous speed.

In small scale installations, in which a hydraulic turbine is used to generate low power levels in the range of 100 h.p. or less because of the limited availability of water pressure, unless the load demands are carefully regulated, the output of such a turbine can easily be exceeded by peak loading. In such a limited water pressure situation, other means must be found for boosting the output of the turbine to meet peak loading demands.

OBJECT OF THE INVENTION

The principal object of the present invention is to provide electrically controllable means for boosting the output of a water turbine to accomodate variable load conditions.

SUMMARY OF THE INVENTION

An electro-hydraulic power converter for transforming the kinetic energy of a moving stream of water into rotary power is disclosed. A rotor is received within a power flow housing and has turbine blades for imparting a mechanical turning force on the rotor in response to fluid flow through the power flow housing. An impulse chamber having sidewall portions defining a diverging passage is coupled to the power flow housing inlet port. Electrodes are received within the impulse chamber for conducting an electrical discharge within the impulse chamber. When an electrical arc is conducted between the electrodes, the water flowing through the impulse chamber into the power flow chamber is vaporized, and a shock wave is propagated through the impulse chamber. The shock wave is reacted in part by the mass of the water in the impulse chamber, and by baffle plates. The shock waves and the expanding water vapor provide increased torque output. The intensity and frequency of the electrical arc discharge are increased to accomodate an increase in the mechanical loading above the rated capacity of the turbine unit.

The novel features which characterize the invention are defined by the appended claims. The foregoing and other objects, advantages and features of the invention will hereinafter appear, and for purposes of illustration of the invention, but not of limitation, an exemplary embodiment of the invention is shown in the appended drawings.

DESCRIPTION OF THE PREFERRED EMBODIMENTS

Figure 1:
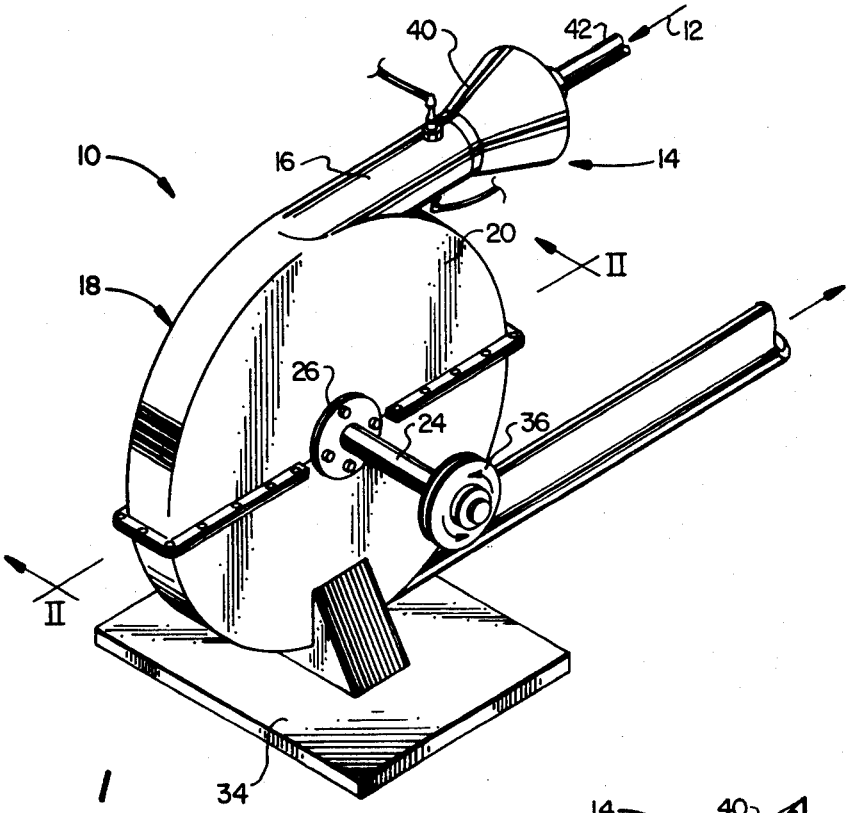
FIG. 1 is a perspective view of a hydraulic turbine having an impulse chamber for boosting its output by electrical means.

In the description which follows, like parts are marked throughout the specification and drawings with the same reference numerals, respectively. The drawings are not necessarily to scale, and in some instances, proportions have been exaggerated in order to more clearly depict certain features of the invention.

Figure 2:
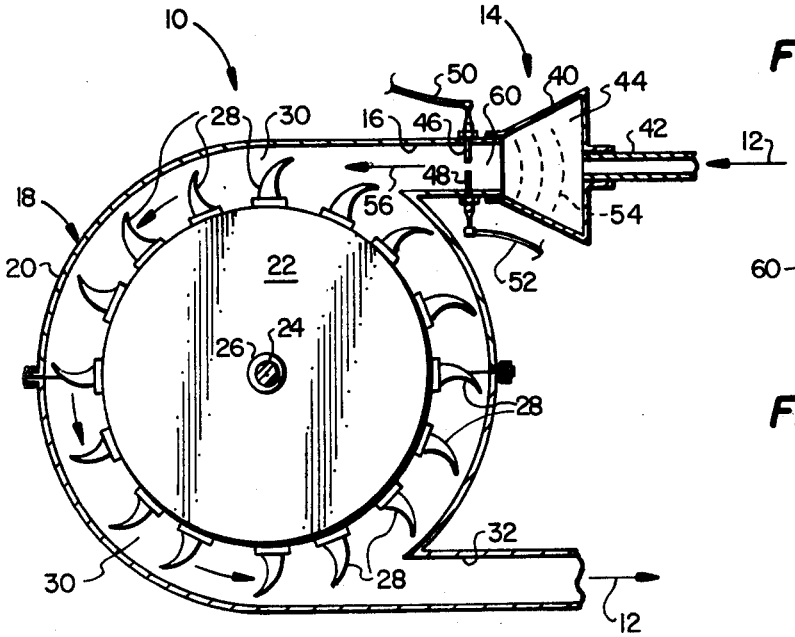
FIG. 2 is a section view, taken along the lines II—II of FIG. 1.

Referring now to FIGS. 1 and 2, an electro-dynamic power converter 10 for transforming the kinetic energy of a moving stream of water 12 has an impulse chamber 14 for boosting its output in response to increased load demands. The impulse chamber 14 is coupled to the inlet port 16 of a hydraulic turbine assembly 18. The hydraulic turbine assembly 18 includes a turbine housing 20 within which a turbine rotor 22 is received. The rotor 22 is mechanically attached to a power shaft 24. The power shaft 24 is supported for rotation within the turbine housing 20 by a bearing assembly 26.

The turbine rotor 22 has turbine blades 28 for imparting a mechanical turning force onto the rotor in response to fluid flow through the power flow housing. The turbine blades 28 extend radially into the annulus 30 between the rotor 22 and the turbine housing 20. The flow of water 12 is thus constrained to follow a circular path through the annulus 30 and in doing so, imparts a turning force onto the rotor 22. The water is discharged at or slightly below atmospheric pressure through a discharge port 32.

The overall assembly is supported on a pedestal 34. According to the arrangement shown in FIG. 1, the power shaft 24 is coupled to a pulley 36 for delivering rotary power.

The impulse chamber 14 is formed by a conical housing member 40 which forms a diverging flow passage extending outwardly from the inlet port 16. A feed conduit 42 admits high pressure water flow 12 into the impulse chamber assembly 14. The conical housing 40 encloses an impulse chamber 44 which is pressurized with water during operation.

According to an important aspect of the invention, a pair of electrodes 46, 48 are mounted near the throat of the diverging flow passage formed by the impulse chamber 44. The electrodes 46, 48 are insulated with respect to each other by suitable means whereby a high energy arc can be conducted from one electrode to another within the flow passage space near the throat of the impulse chamber. Electrical conductors 50, 52 are attached to the electrodes 46, 48, respectively, for conducting the flow of electrical current from an external power source (not illustrated). The external power source may be, for example, a bank of heavy-duty storage capacitors which are charged by a high energy pulse circuit (not illustrated). The frequency and intensity of the arc discharge are controlled by suitable means (not illustrated) to accomodate mechanical loading on the turbine rotor which exceeds the rated output of the turbine unit.

When an electrical arc is discharged across the electrodes 46, 48, a shock wave is propagated through the impulse chamber 44 along a spherical wave front as indicated by the dashed lines 54 in FIG. 2. The shock waves 54 are reacted by the inertia of the water confined within the impulse chamber 44. This results in the main thrust of the shock wave propagating along the direction indicated by the arrow 56 in FIG. 2. Additionally, the water in the region surrounding the electrodes 46, 48 is vaporized by the high intensity arc, thereby creating a high pressure, expanding region of superheated water vapor. The shock waves produced by the electrical discharge and by the expanding, superheated water vapor impinge upon the rotor blades 28, thereby boosting the torque output of the hydraulic turbine 18. According to this arrangement, the power output of the turbine assembly 18 can be closely controlled and can be boosted very rapidly by electrical discharge means to accomodate sudden increases in load demand, including short demand spikes and sustained overload conditions.

Figure 3:
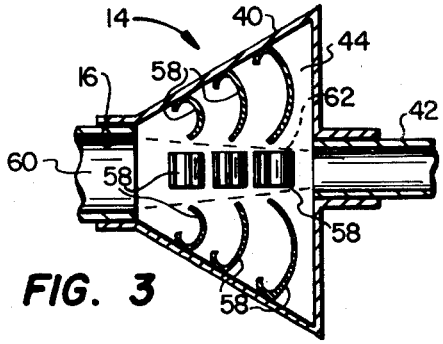
FIG. 3 is a sectional view of an alternate embodiment of the impulse chamber; and, FIG. 4 is a sectional view of yet another alternate embodiment for the impulse chamber.

According to an important aspect of one embodiment of the invention, the shock waves 54 are reacted by curved baffle plates 58 as illustrated in FIG. 3. The shock waves 54 propagate along a spherical front from the throat region 60 into the impulse chamber 44. The curved baffle plates 58 react and reflect the shock waves so that the dominant effect of the shock wave is directed through the annulus 30 of the turbine assembly 18. Preferably, the curved baffle plates 58 are axially spaced with respect to each other throughout the impulse chamber, and are also angularly spaced with respect to each other. The curved baffle plates are arranged so that they do not block the flow of high pressure water 12. The ends of the curved baffle plates 58 terminate adjacent a conical open space as indicated by the dashed lines 62.

Figure 4:
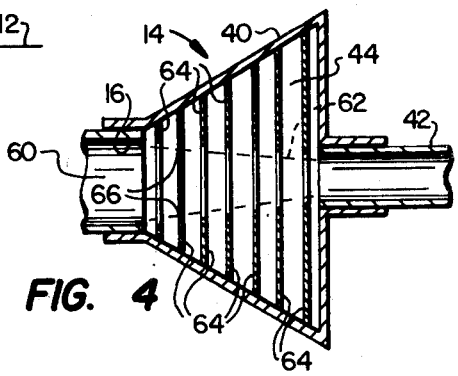

Referring now to FIG. 4, yet another baffle arrangement is illustrated. In this arrangement, flat baffle plates 64 are axially spaced throughout the impulse chamber 44. The baffle plates 64 are preferably in the form of an annular disc, each having a central opening 66 which adjoins the conical open space 62. The flat baffle plates 64 in cooperation with the inertia of the mass of water contained within the impulse chamber 44 react and reflect the shock waves so that the main thrust of each impulse is directed into the annulus 30 and onto the turbine blades 28.

Although preferred embodiments of the invention have been described in detail, it should be understood that various changes, substitutions and alterations can be made therein without departing from the spirit and scope of the invention as defined by the appended claims.

What is claimed is:

1. A method for boosting the output of a hydraulic turbine of the type having a rotor member disposed for rotation within a turbine housing comprising the steps of conducting a high energy discharge of electrical current through water flowing into the water flow inlet of a turbine housing at a high electrical intensity level which produces superheated water vapor and shock waves, and reacting the shock waves and expanding water vapor gases by the inertia of a mass of water contained within a flow passage which diverges with respect to the water flow inlet of the turbine housing, and by reflecting a portion of the shock waves by baffle elements disposed within the divergent flow passage.

2. An electro-dynamic power converter for transforming the kinetic energy of a moving liquid stream into rotary power comprising, in combination:

a housing enclosing a fluid flow chamber and having an inlet port and a discharge port;

a rotor member disposed within said housing for rotation within said fluid flow chamber, said rotor member having turbine blades extending radially into the annulus between said rotor member and said housing for imparting a mechanical turning force onto said rotor in response to fluid flow through said power flow chamber;

an impulse chamber coupled to said housing inlet port, said impulse chamber having an inlet for receiving said moving liquid stream, and having sidewall portions defining a diverging flow passage with respect to said housing inlet port intermediate said impulse chamber inlet port and said fluid flow housing inlet port;

electrode means disposed in said impulse chamber for conducting an electrical discharge within said impulse chamber; and, baffle means disposed in said diverging flow passage.

3. An electro-dynamic power converter for transforming the kinetic energy of a moving liquid stream into rotary power comprising, in combination:

a housing enclosing a fluid flow chamber and having an inlet port and a discharge port;

a rotor member disposed within said housing for rotation within said fluid flow chamber, said rotor member having turbine blades extending radially into the annulus between said rotor member and said housing for imparting a mechanical turning force onto said rotor in response to fluid flow through said power flow chamber;

an impulse chamber coupled to said housing inlet port, said impulse chamber having an inlet for receiving said moving liquid stream, and having sidewall portions defining a diverging flow passage with respect to said housing inlet port intermediate said impulse chamber inlet port and said fluid flow housing inlet port;

electrode means disposed in said impulse chamber for conducting an electrical discharge within said impulse chamber; and, baffle means disposed within said diverging flow passage, said baffle means including a plurality of annular discs supported by said impulse chamber sidewalls, and said discs being axially spaced within said diverging flow passage.

4. An electro-dynamic power converter for transforming the kinetic energy of a moving liquid stream into rotary power comprising, in combination:

a housing enclosing a fluid flow chamber and having an inlet port and a discharge port;

a rotor member disposed within said housing for rotation within said fluid flow chamber, said rotor member having turbine blades extending radially into the annulus between said rotor member and said housing for imparting a mechanical turning force onto said rotor in response to fluid flow through said power flow chamber;

an impulse chamber coupled to said housing inlet port, said impulse chamber having an inlet for receiving said moving liquid stream, and having sidewall portions defining a diverging flow passage with respect to said housing inlet port intermediate said impulse chamber inlet port and said fluid flow housing inlet port;

electrode means disposed in said impulse chamber for conducting an electrical discharge within said impulse chamber; and, baffle means disposed within said diverging flow passage, said baffle means including a plurality of curved baffle segments attached to said impulse chamber sidewalls, said curved baffle segments being axially and angularly spaced within said diverging flow passage.

* * * * *